US006718988B1

(12) United States Patent
Cooper et al.

(10) Patent No.: US 6,718,988 B1
(45) Date of Patent: Apr. 13, 2004

(54) PRESSURIZED TOBACCO DRYING PROCESS

(75) Inventors: Wendy Stella Cooper, Royston (GB); Paul Clive Chadwick, Brackley (GB); Helen Elizabeth Ruth Howitt, Andover (GB)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 10/088,958

(22) PCT Filed: Sep. 22, 2000

(86) PCT No.: PCT/GB00/03618

§ 371 (c)(1),
(2), (4) Date: Mar. 22, 2002

(87) PCT Pub. No.: WO01/21017

PCT Pub. Date: Mar. 29, 2001

(30) Foreign Application Priority Data

Sep. 24, 1999 (GB) ..... 9922746

(51) Int. Cl.[7] ..... A24B 3/04

(52) U.S. Cl. ..... 131/300; 131/303; 131/304; 131/306

(58) Field of Search ..... 131/296, 300, 131/291, 304, 306; 34/329, 343, 348, 359, 360, 362

(56) References Cited

U.S. PATENT DOCUMENTS

| | | | | | |
|---|---|---|---|---|---|
| 3,357,436 | A | * | 12/1967 | Wright | 131/303 |
| 3,661,071 | A | * | 5/1972 | Toei et al. | 99/323.4 |
| 3,678,939 | A | * | 7/1972 | Key et al. | 131/304 |
| RE29,298 | E | * | 7/1977 | Banks | 131/300 |
| 4,148,325 | A | * | 4/1979 | Solomon et al. | 131/302 |
| 4,211,243 | A | | 7/1980 | Ohno et al. | |
| 4,315,515 | A | * | 2/1982 | Mills, III | 131/303 |
| 4,407,306 | A | * | 10/1983 | Hibbitts | 131/296 |
| 4,418,706 | A | | 12/1983 | Kim et al. | |
| 4,513,758 | A | * | 4/1985 | Henzelin et al. | 131/291 |
| 4,528,995 | A | * | 7/1985 | Korte et al. | 131/304 |
| 4,646,760 | A | * | 3/1987 | Egri | 131/296 |
| 4,687,007 | A | | 8/1987 | Denier et al. | |
| 4,844,101 | A | * | 7/1989 | Hirsch et al. | 131/296 |
| 5,060,670 | A | * | 10/1991 | Egri | 131/304 |
| 5,307,822 | A | | 5/1994 | Egri | |
| 5,740,817 | A | * | 4/1998 | Cunningham | 131/291 |
| 5,908,033 | A | * | 6/1999 | Korte et al. | 131/296 |
| 6,397,851 | B1 | * | 6/2002 | Pluckhahn et al. | 131/296 |

FOREIGN PATENT DOCUMENTS

| | | |
|---|---|---|
| DE | 33 15274 A1 | 11/1983 |
| DE | 3240176 A1 | 5/1984 |
| EP | 0 546 986 A1 | 6/1993 |
| GB | 2 120 921 A | 12/1983 |
| GB | 2 193 076 A | 2/1988 |
| WO | WO 97/04673 | 2/1997 |

* cited by examiner

*Primary Examiner*—Steven P. Griffin
*Assistant Examiner*—Carlos Lopez
(74) *Attorney, Agent, or Firm*—John F. Salazar; Middleton Reutlinger

(57) ABSTRACT

This invention describes a pressurized drying process particularly useful for changing the aroma of Burley tobacco, and the taste and flavor of cigarettes comprising such processed tobacco. Burley tobacco is treated in a pressurized dryer at temperatures of 120° C. or more in a pressure range of 0.25–7 Bar absolute to provide a processed Burley tobacco with a more toasted character. Other tobaccos may also be treated in a similar manner to effect a change in expansion

28 Claims, 10 Drawing Sheets

PRESSURIZED TOBACCO DRYING PROCESS

This invention relates to the processing of tobacco, particularly, but not necessarily, Burley tobacco.

Burley tobacco generally requires heat treatment to improve its flavour and aroma characteristics before it is used in tobacco products.

Known methods of treating Burley tobacco involve heating Burley lamina which has been cased to produce a toasted character on heating. Casings are predominantly mixtures of sugars, cocoa, licorice and humectants, the sugars of which, when heated to an appropriate temperature and for an appropriate time lead to the formation of components which give favourable aroma/sensory attributes. Two basic types of reactions result in the production of these favourable components (often referred to in the tobacco industry as "toasting"); reactions of reducing sugars with components possessing a free amino group (Maillard reactions) and reactions in which sugars are heated in the absence of amino groups (browning reactions). Browning reactions generally require higher temperatures than Maillard reactions. The formation of favourable aroma compounds depends on the product temperature, residence time and tobacco input/output moisture.

The maximum temperature to which the Burley tobacco is subjected in known treatments, such as the Cased Leaf Drying process (such as the Proctor Cased Tobacco Dryer described in, Proctor & Schwartz, Inc. Dryer Handbook), is 1500° C. and typically residence times of 190 seconds are used. However, because the temperature of the tobacco does not start to rise until all free unbound moisture is released (i.e. the critical moisture content is reached; see FIG. 2), the tobacco itself may not actually achieve this temperature during conventional treatments.

In order for the Burley tobacco to reach the temperature required for these chemical reactions to occur in the conventional treatments, the dryer output moisture content of the tobacco must be below 7%. At these low moisture levels, the tobacco is brittle and difficult to process without causing a detrimental effect on product quality. Therefore, after conventional heat treatment, the Burley tobacco must be cooled and re-wet to about 20% moisture so that it can be cut. After cutting, the Burley tobacco must then be dried again to moisture levels suitable for the manufacture of tobacco products (typically 12% to 16%).

U.S. Pat. No. 4,687,007 describes a process for the pressurised drying of a standard lamina tobacco blend incorporating flue-cured, oriental, Burley and reconstituted tobaccos in order to expand the blend and improve the quality, i.e. reduce the impact and irritation.

The present invention, in contrast, provides a process for heat treating Burley tobacco in a Burley processing line at elevated pressures which results in high tobacco temperature being achieved at a higher moisture content. The higher tobacco temperature improves the formation of aromatic and flavouring components at high tobacco moisture levels, so that the Burley tobacco can be produced at a moisture content suitable for cigarette production.

The present process allows the preparation of Burley tobacco for use in tobacco products to be simplified. Whereas in known processes, cased Burley tobacco has to be toasted, cooled, re-wet, cut and then dried to the final product moisture in separate stages, using the present process the Burley tobacco can be dried and toasted in one process stage to a desired product moisture. This line is known as a Burley processing line. As used herein the term "Burley processing line" means a line processing substantially only Burley tobacco, whether whole leaf, sliced or cut leaf, or stem or lamina parts only. The present invention results in a considerable saving in process time and cost.

It is also an object of the present invention to provide improved aroma of low quality processed Burley tobacco, and ideally subsequent taste and flavour of smoked cigarettes comprising Burley tobacco processed according to the invention.

It is also a further object of the present invention to provide processed Burley tobacco with improved aroma characteristics, without the need for addition of casing material.

The present invention provides a process of treating Burley tobacco in a Burley processing line, said process comprising heating Burley tobacco in a Burley processing line in a pressurised closed dryer to a tobacco temperature of 120° C. or more at a pressure which is in the range of 0.25 to 7 Bar absolute, the moisture content of the Burley tobacco being maintained above 10% during the process, and the moisture content of the Burley tobacco exiting the system being greater than 10%, the aroma and/or taste and flavour characteristics of thus treated Burley tobacco being altered to become more toasted.

Preferably the process is performed in a pneumatically conveyed closed loop dryer.

Preferably pressurised superheated steam is the conveying and drying medium.

It is preferable that the Burley tobacco used in the process is pre-cut. Alternatively, the Burley tobacco may be cut after processing, as in conventional Burley treatment processes.

The Burley tobacco used in the pressurised process preferably has an input moisture content above 20%, preferably 25% or more, and even more preferably 30% or more, and may even be up to 45%, all by weight of the tobacco.

The input temperature of the tobacco in the pressurised process may be in the range of 20° C. to 100° C., and is advantageously above 50° C.

Burley tobacco is fed into the dryer through a pressure tight feed inlet directly into a flow of superheated steam which is at a temperature of 200° C. to 300° C.

Preferably the superheated steam is at a temperature of 220° C. or more, more preferably 230° C. or more, depending on the pressure conditions and tobacco residence times utilised.

The tobacco is transported through the dryer suspended in the superheated steam.

The tobacco is heated by the steam to a product temperature of at least 120° C., more preferably at least 130° C. and most preferably at least 140° C.

The dryer is preferably operated at pressures of from 1 to 7 Bar absolute, preferably above 2 Bar absolute and more preferably in the range of 3 to 7 Bar absolute.

The moisture loss from the tobacco may be from 5% to 30%, depending on the input moisture content of the tobacco and final moisture content required.

The residence time of the Burley tobacco at the elevated temperature and pressure may be from 5 to 25 seconds, more preferably 7 to 15 seconds. A short residence time may be 7–8 seconds and a long residence time may be 15 seconds. Residence time of the tobacco in the dryer will depend on the taste and flavour characteristics required.

The tobacco is then separated from the transport steam, for example in a high efficiency cyclone, and then discharged from the dryer through a pressure tight outlet.

After treatment, the moisture content of the tobacco, i.e. the exit moisture content, is advantageously from 10% to 25%, and is preferably 14% to 16%. The tobacco exit temperature from the dryer is in the range of 90° C. to 1400C.

In addition to an improvement in sensory characteristics, the treatment may also result in some expansion of the Burley tobacco, so that the bulk density of the Burley tobacco is reduced after the process. Advantageously the tobacco is expanded by 5% or more, more advantageously by 10% or more and even more advantageously by 15% or more.

The raised pressure during the heat treatment allows the tobacco to be heated to higher temperatures than previous processes without drying out. The high temperature increases the rate of Maillard and browning reactions so the product has more aromatic reaction products than would otherwise be present. The drying treatment also releases ammonia from the tobacco. Once released, this becomes available to react with sugar groups in Maillard reactions. Ammonia is re-circulated around the dryer, if used, and is therefore more readily available for reaction to produce favourable aroma compounds. Because the higher temperatures required for the toasting reactions can be obtained without drying below normal final product moisture levels, i.e. about 7% in a Cased Leaf Dryer, the Burley product can be used in production without further wetting.

The Burley tobacco may advantageously undergo pre-treatment prior to pressurised drying, i.e. the process, in which pre-treatment it is heated at ambient pressure. This heating is optional and improves the penetration of the Burley tobacco during moistening or casing stages. The heating may be achieved by contacting the tobacco with steam. The temperature of the preheated tobacco is preferably in the range of 50° C. to 100° C. and may be in the range of 60° C. to 70° C.

Moistening may be achieved by introducing water into the tobacco to provide a tobacco moisture content of 45%, for example. The water is in the form of steam or steam atomised water droplets.

It may be desirable to in addition or in the alternative add casing to the Burley tobacco. Casings are flavourings designed to improve the flavour and aroma of tobacco. Casing solution may be introduced as part of the moistening water, preferably as droplets atomised in steam.

A cooling step may be carried out after the pressurised process to lower the temperature of the tobacco and thereby avoid cooling by evaporation of water. Cooling may be achieved by introducing tempered air into the tobacco stream. It is preferable that the product has a temperature of from 50° C. to 60° C. on exit from the cooling stage.

The present invention further provides a smoking material the product of the above process.

The present invention further provides a smoking article comprising a filter element attached to a smoking material rod wrapped in a wrapper, the rod comprising Burley tobacco material processed according to the invention.

The smoking article may comprise up to 100% of Burley tobacco processed according to the invention.

The present invention further provides a processed Burley smoking material exhibiting a more toasted character than processed Burley produced by a cased leaf dryer, the smoking material having one or more increased cocoa, caramellic, burnt sugar or nutty/roasted attribute (s) as described herein.

Preferably processed Burley smoking material has a significantly different caramellic attribute compared with a control material treated in a conventional cased leaf dryer (see Table 11).

The treatment process described above may also be used for other types of tobacco to reduce the bulk density thereof and confer favourable sensory characteristics.

The present invention further provides a process for treating tobacco stem or flue-cured lamina tobacco in a pressurised dryer comprising heating the stem or flue-cured lamina to a tobacco temperature up to 120° C. at a pressure which is in the range of 0.25–4 Bar absolute, the moisture content of the tobacco being maintained above 10% during the process, and the moisture content of the tobacco exiting the dryer being greater than 10%, in order to provide a filling power improvement compared with conventional stem or flue-cured lamina processes.

The tobacco stem or flue-cured lamina is fed into the dryer through a feed inlet directly into a flow of superheated steam which is set at a temperature of 150° to 300° C.

In order that the invention may be easily understood and readily carried into effect, reference will now be made, by way of example, to the diagrammatic drawings hereof, in which:

FIG. 6 shows the Principal Component Analysis (PCA) of sensory data from tobacco samples shown in Table 1, which lists the tobacco samples rated for aroma characteristics by an expert panel of evaluators.

FIG. 7 shows the loading plot of the descriptors of the principal component analysis.

FIG. 8 shows aroma profiles for Burley lamina tobacco treated under the conditions described in Table 6.

FIG. 9 shows aroma profiles for Flue-cured lamina tobacco.

FIG. 10 shows aroma profiles for Cut Rolled Expanded Stem.

EXAMPLE 1

Figure 1:
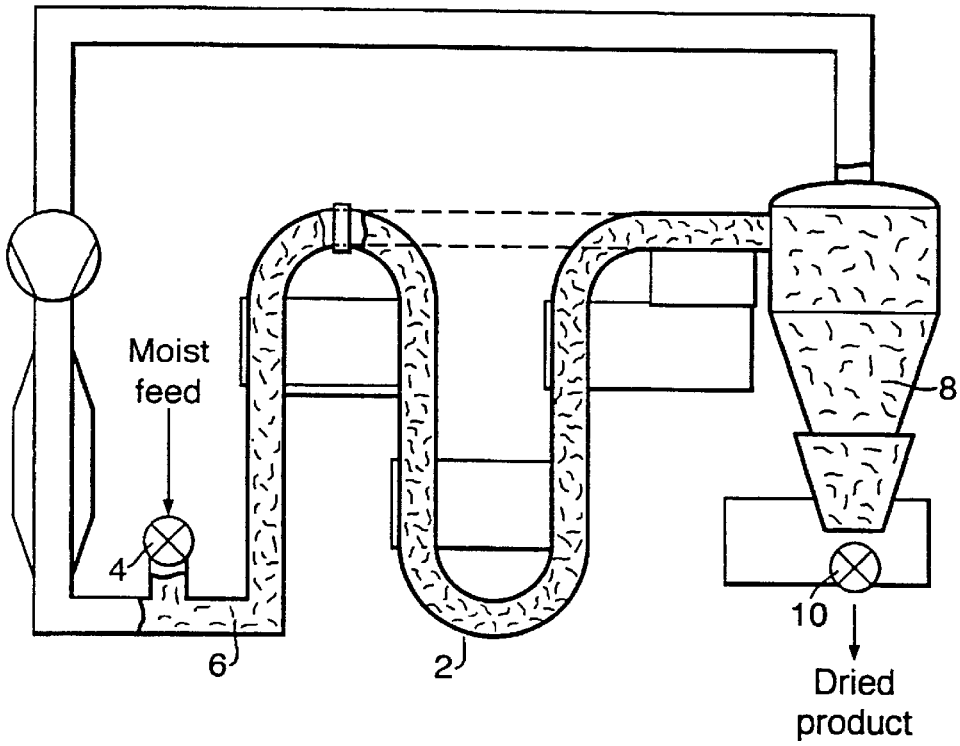
FIG. 1 shows a diagram of a pneumatically conveyed closed ring dryer suitable for use in processes embodying the present invention.
Figure 2:
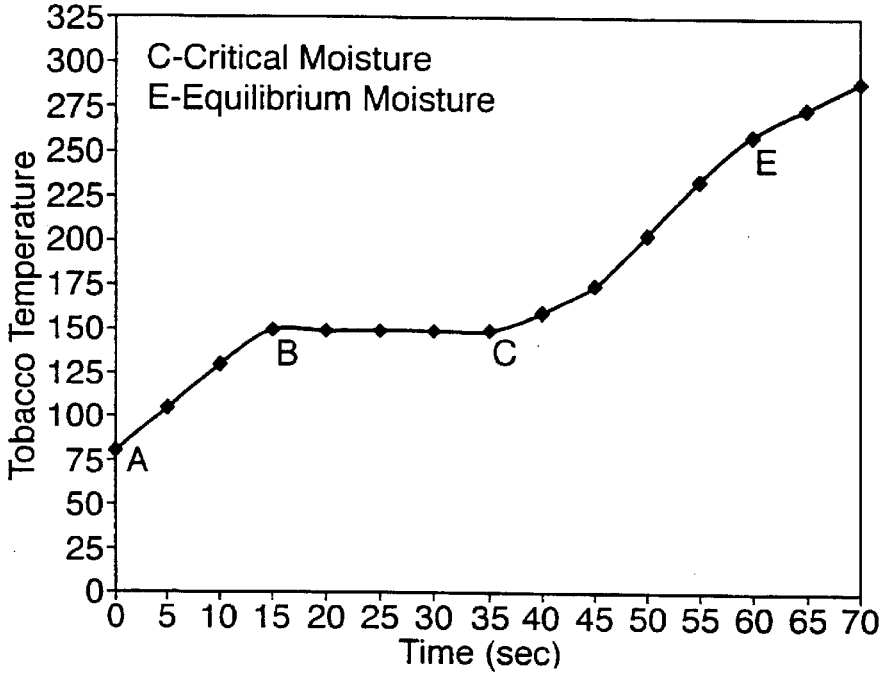
FIG. 2 shows a graph depicting the drying of tobacco and highlighting the critical moisture content of tobacco.

Samples of Burley lamina were cased and conditioned to a moisture content of 35% by conventional means and fed through a pressure tight feed inlet 4 into a pneumatically conveyed closed loop dryer 2 (see FIG. 1). The conditions for the pressurised drying treatment of each sample within the pneumatically conveyed closed loop dryer 2 are shown in Table 6.

Each Burley sample was conveyed through the dryer using pressurised superheated steam 6. Flow rates of the samples through the dryer ranged from 242 to 325 Kg/h dry solids at pressures of from 1.41 to 3.69 Bar abs. The flow rate and pressure of the steam used for each sample are shown in Table 6.

Conveyance by the superheated steam raised the temperature of the product to about 110° C. to 140° C. for the pressures tested. Samples were subjected to these conditions for a short residence time ('ST') of 7–8 seconds or a long residence time ('LT') of 15 seconds.

The sample was separated from the steam using a cyclone 8 and discharged from the dryer 2 through a pressure tight outlet 10.

Figure 5:
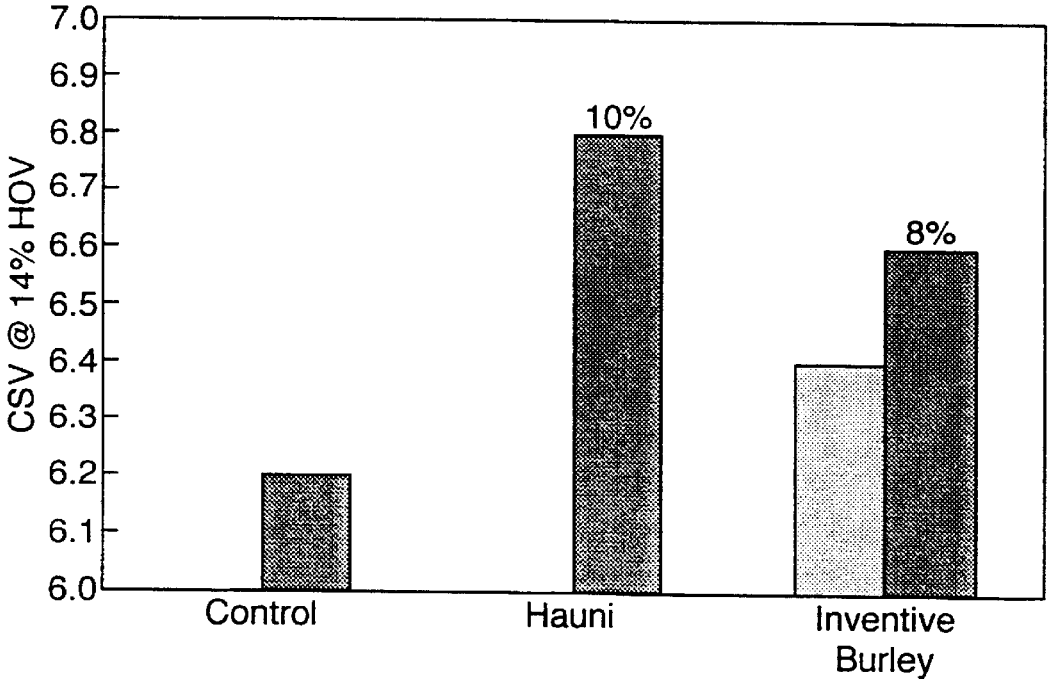
FIG. 5 is a graph showing the expansion of Burley lamina tobacco during toasting by the present process compared to a known process. The two columns for the inventive process represent minimum and maximum values obtained over the range of conditions used in the experiments (see Table 6).

The final cut Burley product achieved was at 15% to 17% moisture. The expansion of the product was then measured and its aroma characteristics were assessed. The expansion of the Burley lamina (between 3% and 8%) is tabulated in Table 6 and is shown in FIG. 5. It can be seen that the expansion achieved by the present process is comparable to that achieved by known processes. The main benefit of this process, however, lies in the modifications to the aroma and/or taste and flavour of the processed Burley lamina, as described below.

EXAMPLE 2

The aroma characteristics of the Burley tobacco samples of Example 1 were assessed by an expert panel of evaluators (see Table 1).

Samples (approx. 8 g) of treated tobacco were placed in 530 ml plastic tubs with 'snap secure' lids lined with 185 mm×245 mm plastic food bags which overlapped the sides of the container. The products were identified by a code written on the bag overlap after the lid had been placed on the tub. Sufficient tubs were prepared to ensure that each was used by no more than two assessors. Order of presentation was balanced over subjects. The products were assessed for aroma by removing the plastic lid and holding the container close to the nose. The products were rated on a continuous scale on thirteen attributes, namely; aroma intensity, green/grassy, hay-like, musty/earthy, woody, nutty/roasted, burnt caramellic, caramellic, chocolate/cocoa, fruity/fermented, acidic/rancid, animal and ammoniacal.

Figure 8:
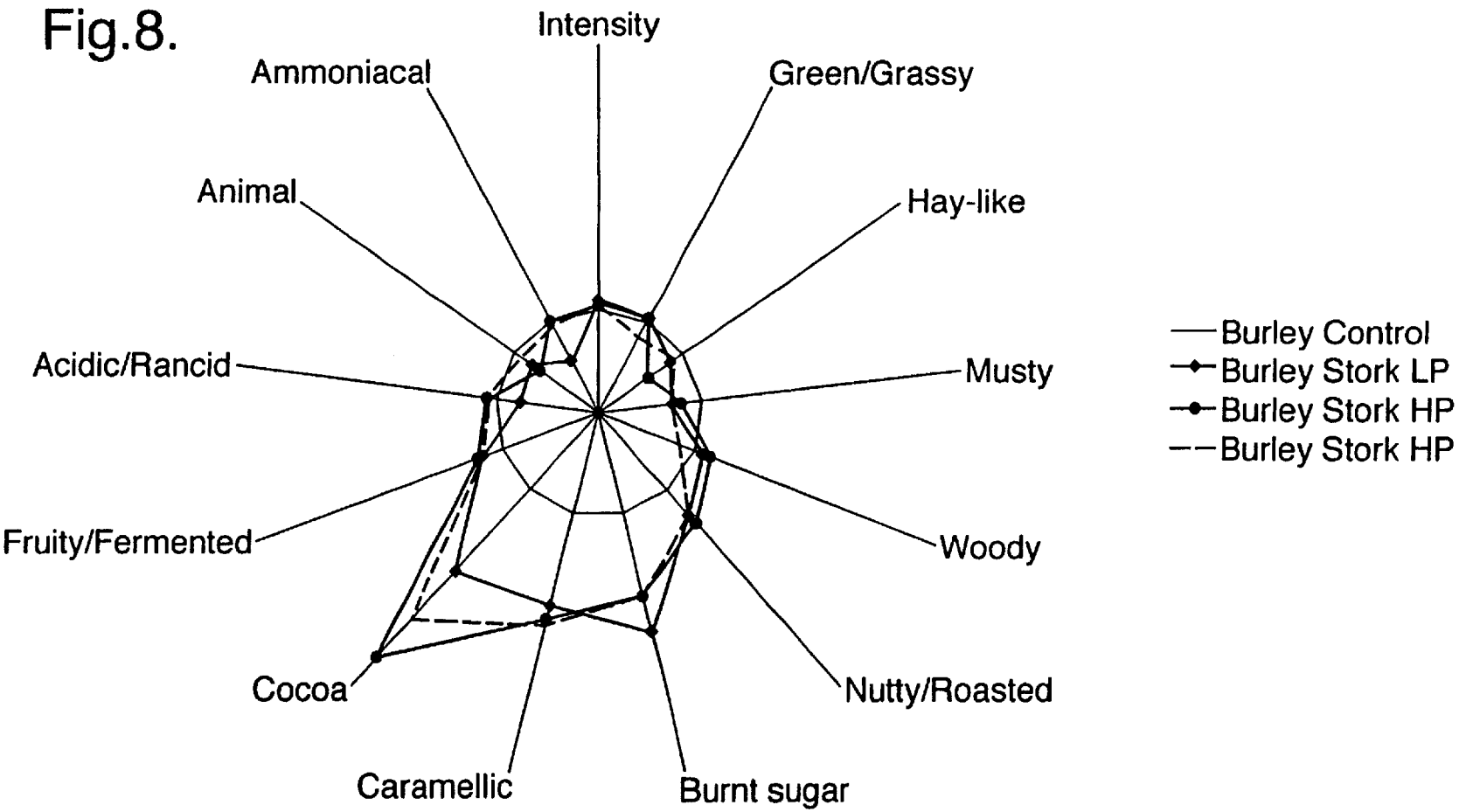

The results were plotted as an aroma profile for Burley tobacco treated under various drying conditions (FIG. 8). It can be seen that the pressurised drying process results in marked changes in the aroma characteristics of the Burley tobacco. There is a large increase in favourable aroma characteristics such as cocoa, caramellic and burnt caramellic flavours, without any increase in negative aroma attributes. This increase is more marked as the pressure of the treatment increases.

EXAMPLE 3

The present process can also be used to treat uncased Burley tobacco in accordance with the same general process. The pre-treatment can be adapted for Burley lamina without casing by omitting the casing solution at the moistening stage of the pre-treatment. The aroma attributes were measured in the same way as in Example 2.

EXAMPLE 4

Uncut whole leaf Burley was also cased and treated by a similar process to that described for cut Burley tobacco lamina in accordance with the same general process. The aroma attributes were measured in the same way as Example 2.

EXAMPLE 5

Other types of tobacco can also be treated using this process to expand the tobacco and alter the aroma characteristics. Samples of Flue-cured lamina were dried using the present process (as shown in Table 7A). The Flue-cured lamina was pre-treated by the addition of water to a moisture content of up to 33% and dried using pressures up to 3.7 Bar absolute.

Figure 4:
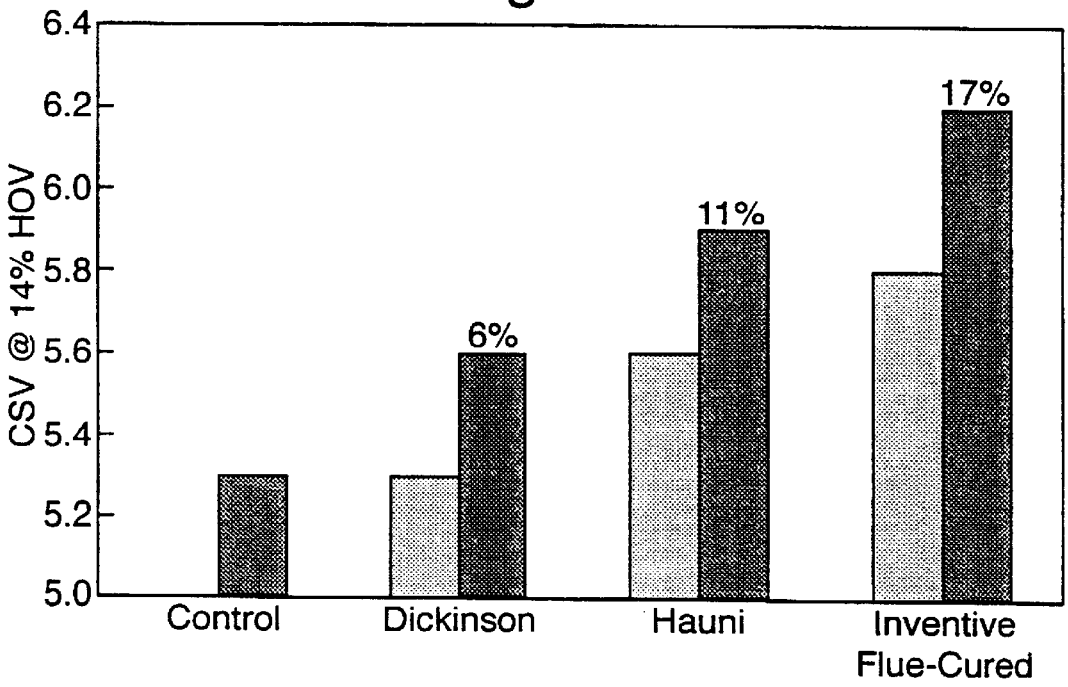
FIG. 4 shows comparisons between known drying methods and the inventive drying method for Flue-cured lamina. The two columns represent minimum and maximum expansion values (Compressed Specific Volume (CSV:cm3/g) at 14% moisture content(Hearson Oven Volatiles: HOV)) obtained over the range of conditions used in the experiments.

The expansion of the Flue-cured lamina using this process compared to known processes is shown in FIG. 4.

Two pneumatically conveyed dryers commercially available were used: Dickinson (HXD), Hauni (HDT) and the pneumatically conveyed closed loop dryer of the present invention. The Hauni (HDT) and Dickinson (HXD) systems are very similar, operating at close to atmospheric pressure. The Hauni apparatus uses superheated steam, giving higher expansion than the Dickinson system. Product temperatures during the drying process reach 80°–100° C. in both Hauni and Dickinson dryers.

The present process produces the most highly expanded product, with up to 17% increase in fill value over the present lamina process.

EXAMPLE 6

Cut rolled stem (CRS) can also be treated according to the present process. Samples of cut rolled stem moistened in a pre-treatment step to moisture contents of between 30% and 50% were fed into the dryer. After treatment, cut rolled stem had a moisture content of 12% to 19%.

Figure 3:
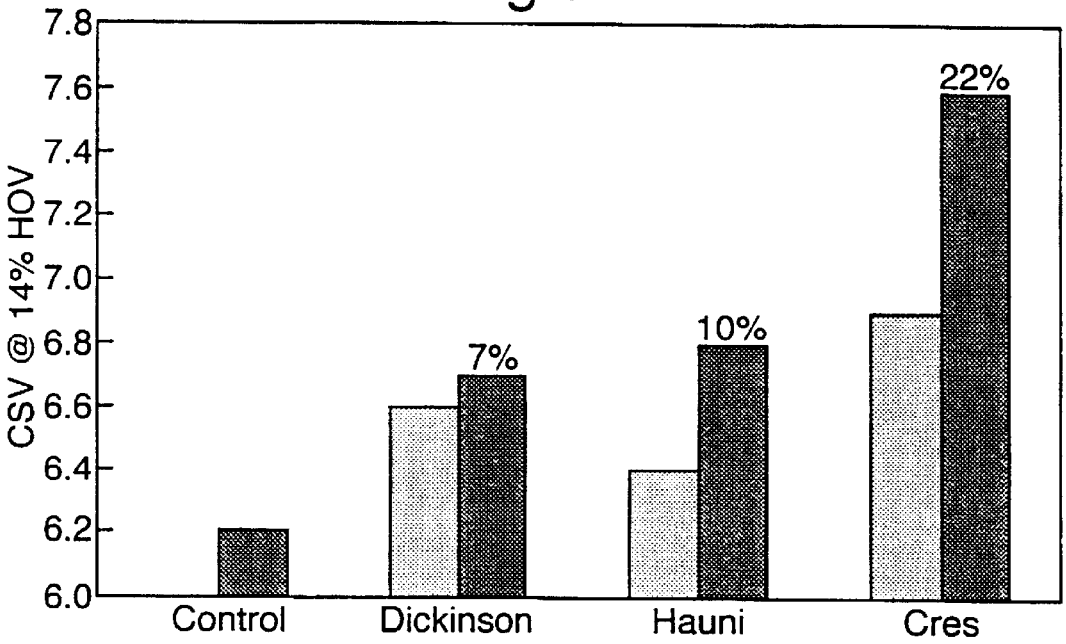
FIG. 3 shows comparisons between known drying methods for Cut Rolled Stem (CRS) and the present drying method for Cut Rolled Expanded Stem (CRES). The two columns represent the minimum and maximum expansion values (Compressed Specific Volume (CSV:cm3/g) at 14% moisture content (Hearson Oven Volatiles: HOV)) obtained over the range of conditions used in the experiments.

The expansion of cut rolled stem using the present process compared to the two known processes described in Example 5 above is shown in FIG. 3. FIG. 3 shows that the present process produces more highly expanded product with up to 23% increase in fill value over the present CRS process without any detrimental effect on particle size distribution.

EXAMPLE 7

Figure 9:
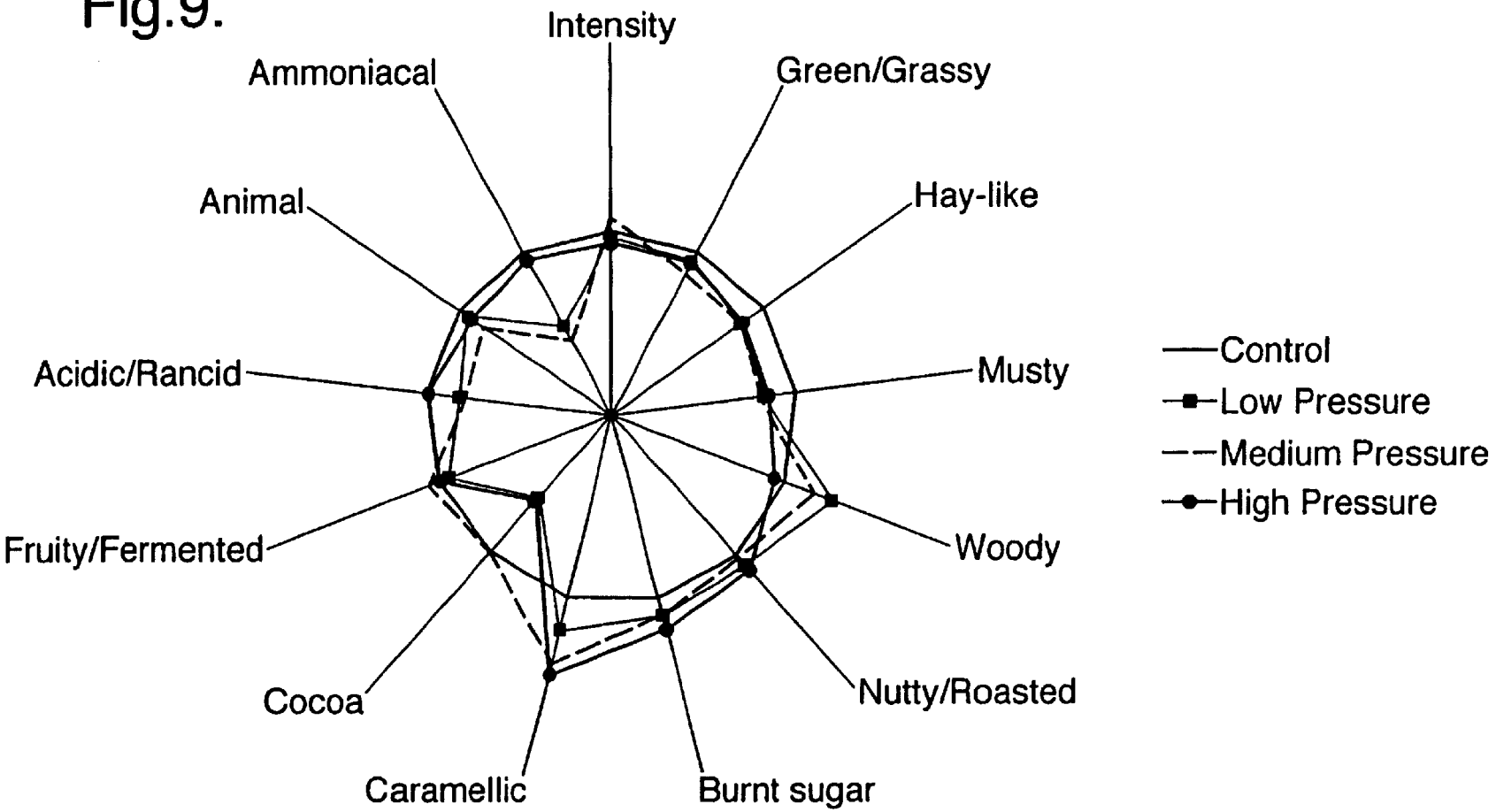
Figure 10:
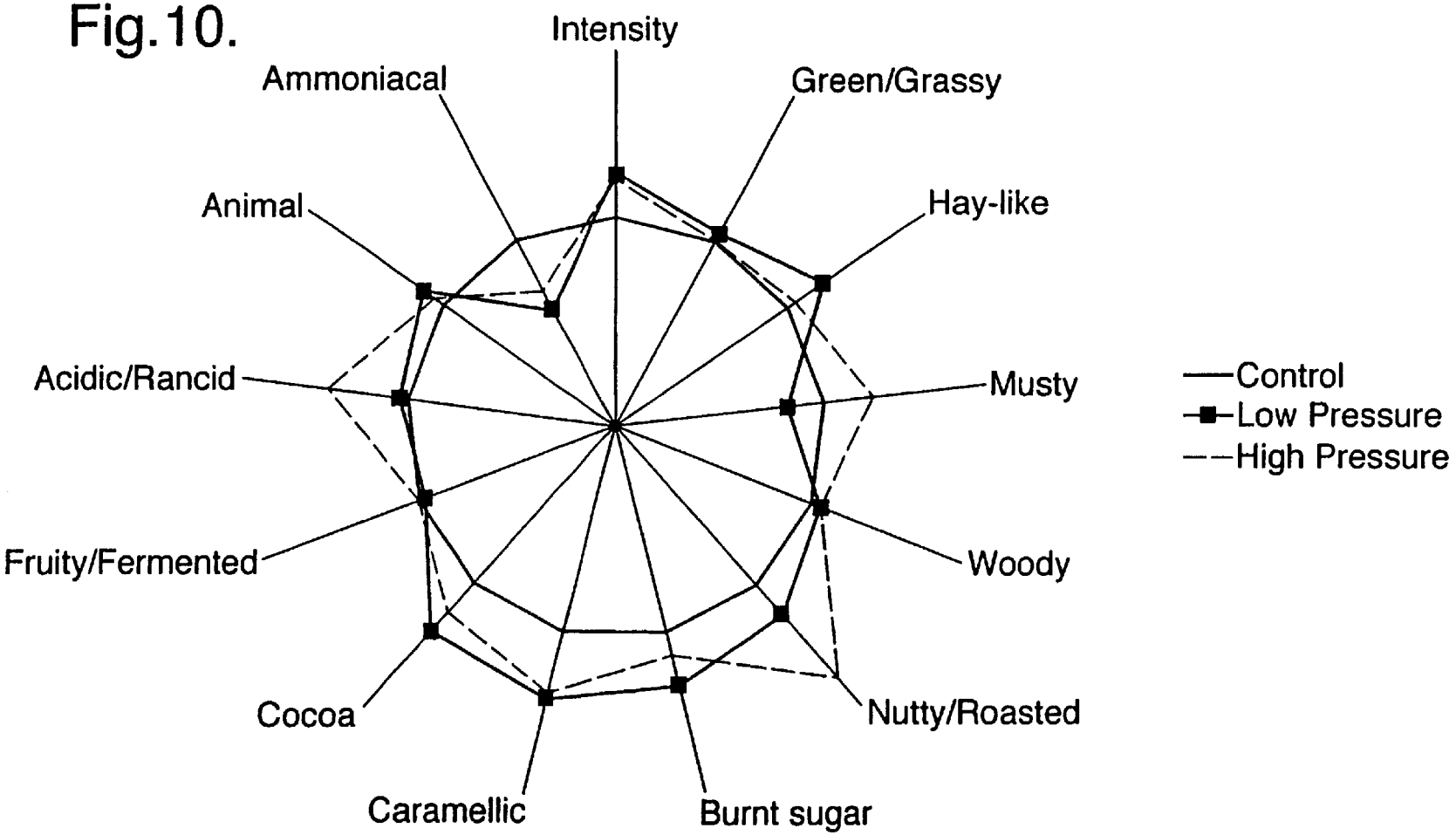

Aroma evaluation was carried out using an expert panel of evaluators as described above on samples of Flue-cured lamina and Cut Rolled Stem which had been treated either with the present process or known drying processes (see Table 1). Aroma profiles were plotted for samples of Flue-cured lamina and Cut Rolled Stem which had been treated by the present process under a variety of conditions (FIGS. 9 and 10). Small flavour changes are apparent for Flue-cured lamina and Cut Rolled Stem, compared to the control materials.

EXAMPLE 8

Figure 6:
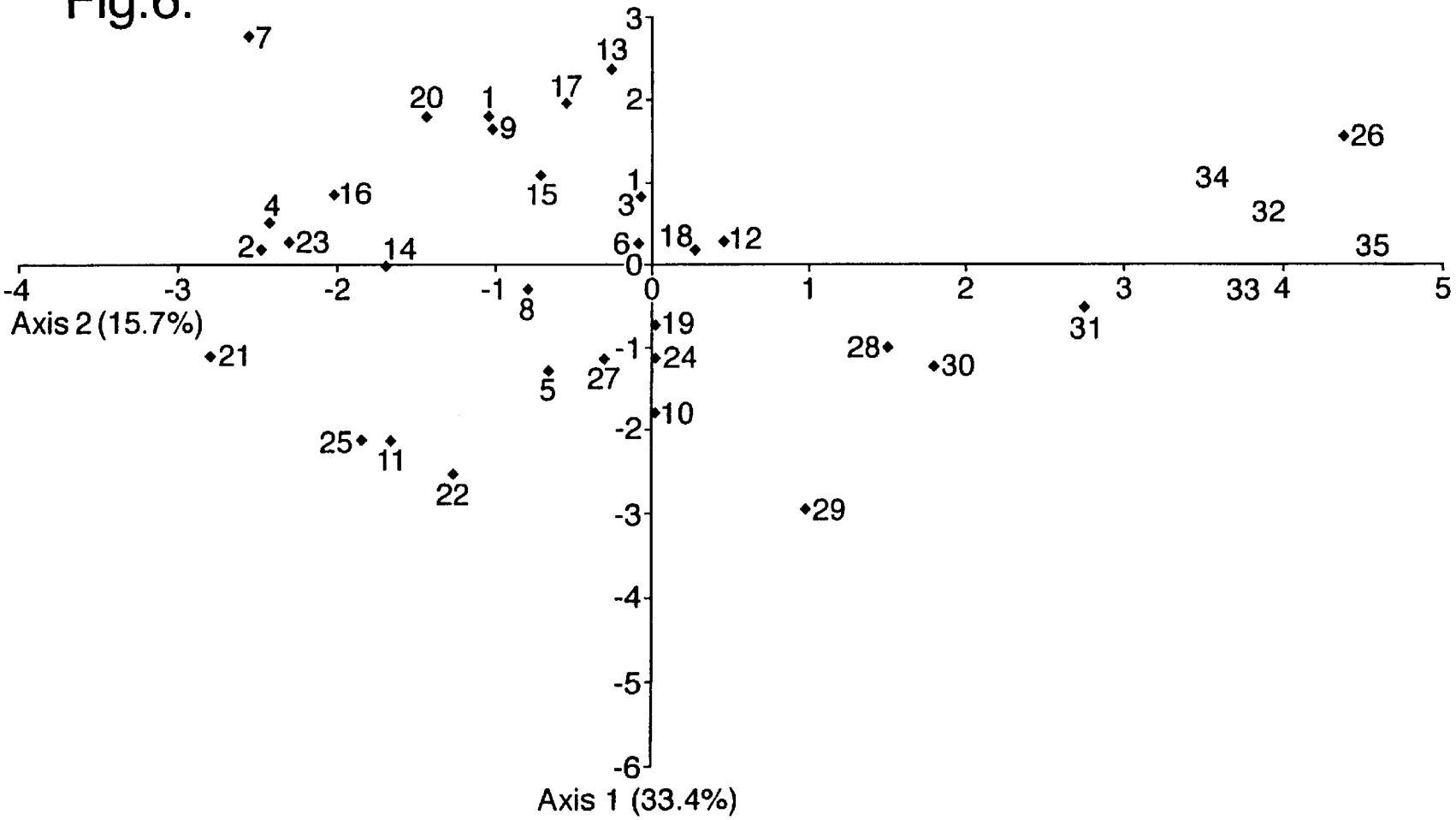
FIGS. 6 to 10 show the results of investigations into the aroma and flavour of treated tobacco.

Principal Component Analysis (PCA) of all the aroma evaluation experiments was undertaken. The first two dimensions of the Principal Component Analysis, which accounted for 33.4% and 15.7% of the total variance were selected. FIG. 6 shows that the samples were discriminated along the first dimension according to their typical Burley notes (animal, ammoniacal), musty and acidic aromas, and according to their grassy, woody, nutty, caramellic and burnt caramellic notes. Principal Component 2 was mainly determined by the hay-like notes on the one hand and the intensity of the aroma, fermented/fruity and chocolate/cocoa on the other hand.

Figure 7:
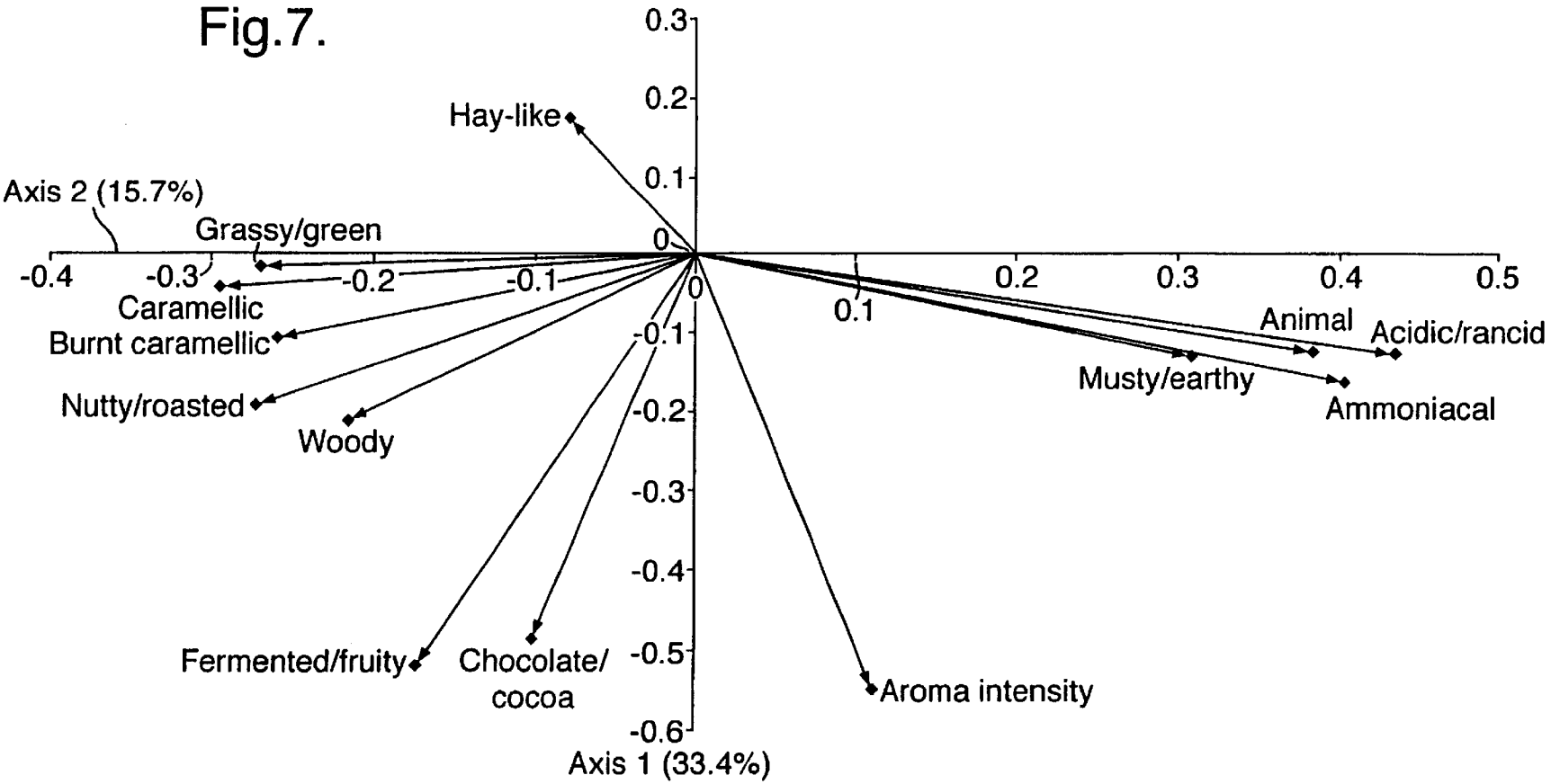

The first factorial map of the samples exhibits a trend of clustering of the tobacco samples according to the tobacco type (when FIG. 6 is overlaid onto FIG. 7). The Burley tobacco samples are well discriminated along the first axis and were characterised by strong animal, ammoniacal, acidic/rancid and musty/earthy notes. After processing the Burley tobacco, the samples are moved towards the left part of the map, indicating the production of more woody, nutty/roasted, caramellic, burnt caramellic, grassy/green notes. Among the other tobacco samples studied, the discrimination is less evident. Samples from Flue-cured lamina and CRS types tend to be regrouped in the same part of the map, producing a range of similar aromas but with variable intensities according to the process, the process conditions and the tobacco type used. For example, sample 10 was perceived to produce a more intense chocolate aroma, while samples 22 and 25 were perceived to be more fruity/fermented in character.

EXAMPLE 9

The results of the two-factor ANOVA (Analysis of Variance), performed in order to detect significant differences between tobacco types, shows a very significant judge effect (Table 8). The disagreement between judges is commonly encountered in sensory analysis and can be explained by the inter-individual differences in the use of the intensity scales. The Duncan multiple comparison test was applied on the thirteen attributes showing significant differences between tobacco type effects. The results are reported in Table 8.

The Burley tobacco exhibited the most different sensory characteristics compared with the CRS and lamina portion samples.

The output of the two factors ANOVA shows a very significant judge effect (Table 9, 10, 11). As already reported, these effects are quite common and do not affect the between product difference.

Concerning the Burley tobacco samples, the intensity, animal and caramellic attributes showed a significant between samples effect (Table 11). It was due to a higher average score of samples 27 and 34 compared with the samples 26, 28, 32, 33 and 34 and 27, 29 and 30 respectively on the aroma intensity attribute. The animal aroma developed by the samples 27 and 29 was significantly less intense than that found in the samples 32, 33, 35 and 26, 28, 31, 32, 33, 34 and 35. Samples 26 and 35 were perceived significantly less caramellic than samples 27, 28, 29 and 30 and 28 respectively.

Significant differences were detected between CRS samples on two attributes, intensity and grassy/green (Table 9). According to multiple comparison test, the samples 11, 6, 5 and 2 were perceived to produce higher aroma intensity than the samples 1 and 7. Samples 4 and 2 presented higher grassy/green aroma intensity than 10 and 6, this last sample being also significantly different from the control (sample 1).

Within tobacco samples of lamina type, no significant difference was perceived (Table 10), suggesting that the aroma produced by the lamina type samples was similar whatever the treatment and conditions used.

EXAMPLE 10

Figure 11:
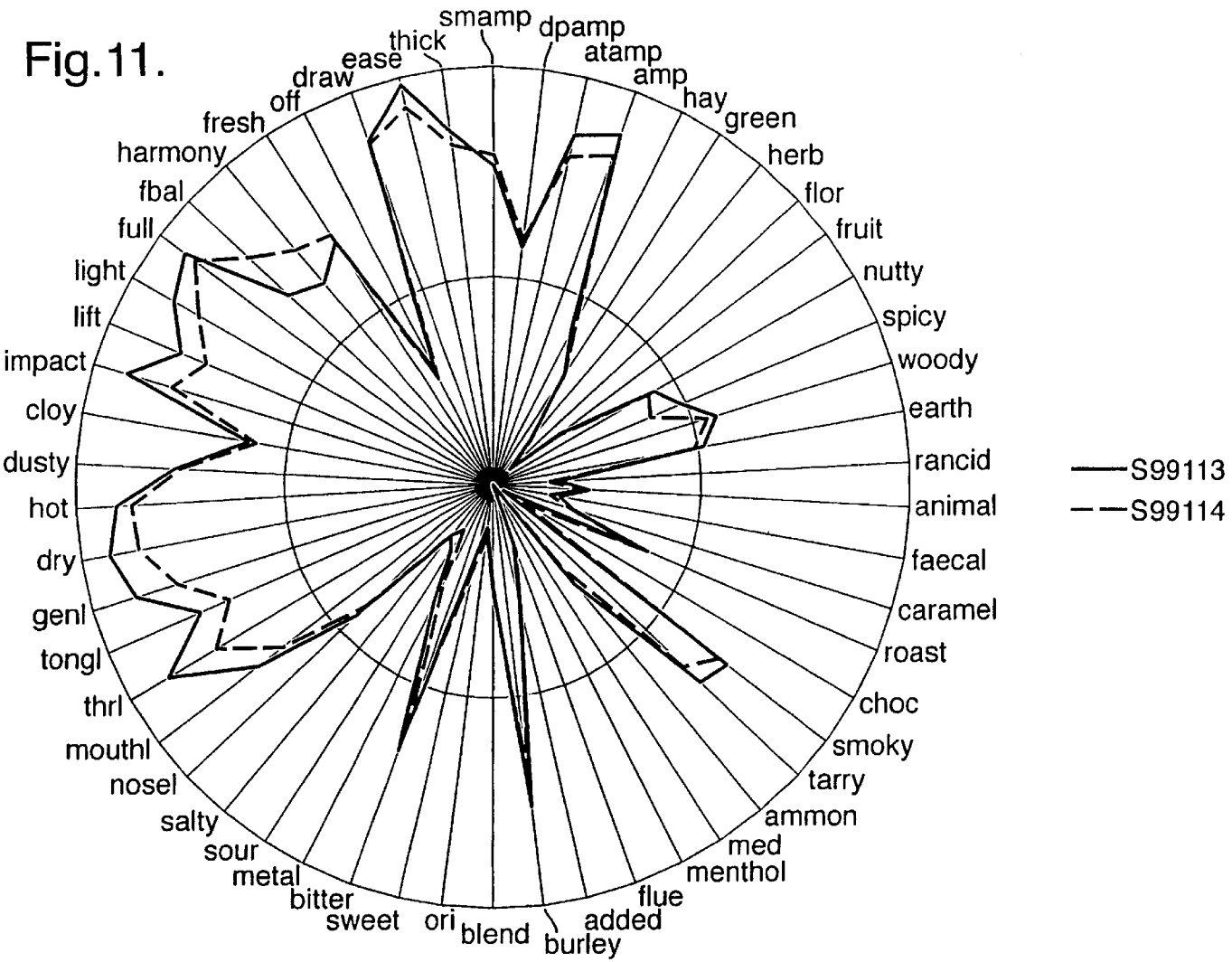
FIG. 11 shows full flavour profile of cigarettes comprising 100% Burley lamina processed according to the invention. S99113 is the control and S99114 is lamina processed at HP, LT.
Figure 12:
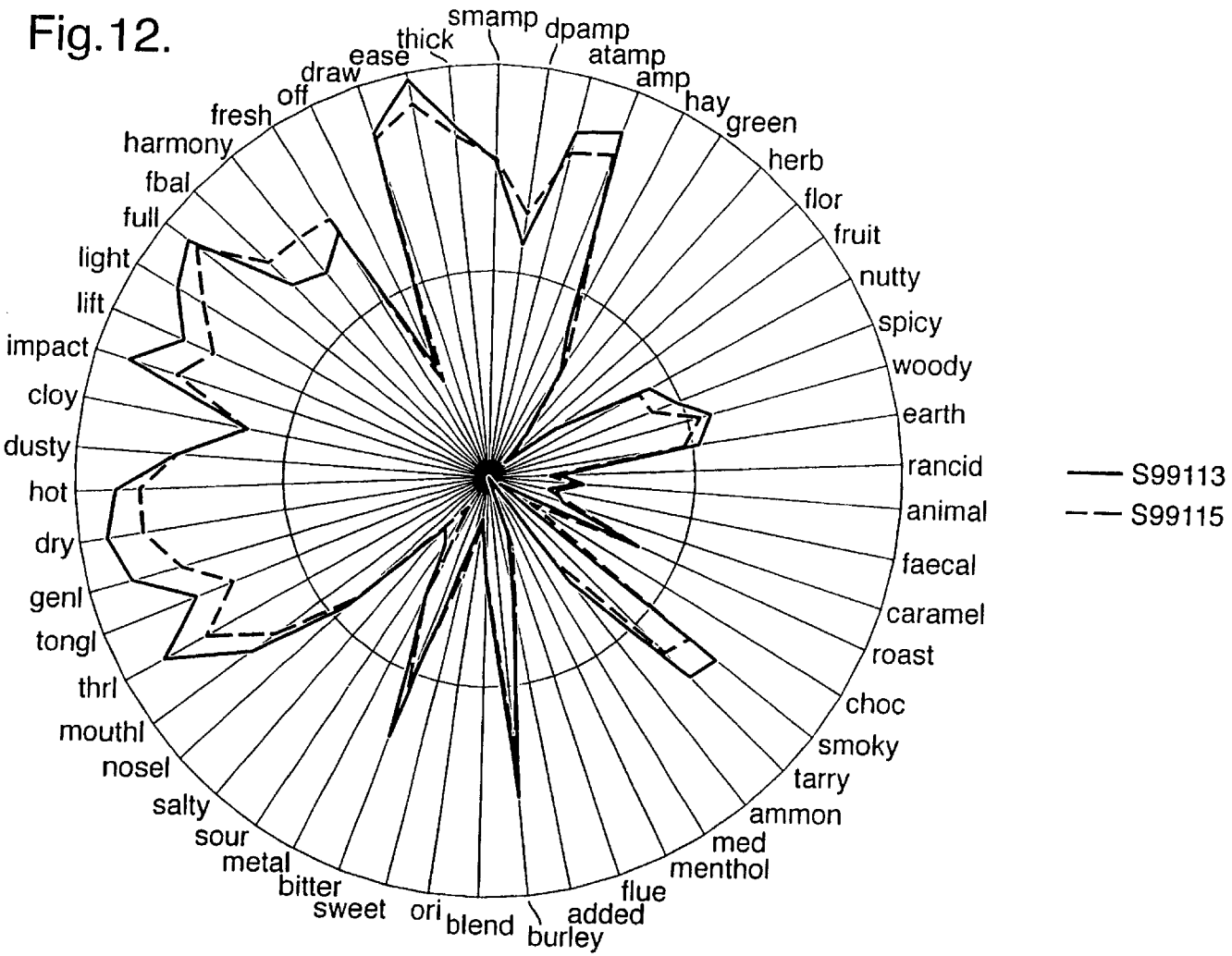
FIG. 12 shows full flavour profile of cigarettes comprising 100% Burley lamina processed according to the invention. S99114 is the control and S99115 is lamina processed at HP, ST.

Sensory evaluation (full flavour profiling) of smoked cigarettes containing 100% of Burley processed lamina was carried out. Each smoke attribute is plotted on a flavour wheel (see FIGS. 11 and 12). Table 12 details the abbreviations for the flavour wheel attributes. The results indicated that cigarettes made with processed Burley lamina were more balanced (significantly increased) and harmonious with less harshness and irritation (significantly decreased). Other smoke attributes are also positively affected for example, the chocolate/cocoa smoke attribute is significantly increased. The mean scores and F ratios of the attributes significantly altered are given in Table 13.

EXAMPLE 11

The physical and sensory characteristics of tobacco treated by the present process were assessed. Cut Rolled Expanded Stem treated by the present process was blended with conventional Flue-cured lamina tobacco (20:80) and made into cigarettes with the same physical characteristics as a control cigarette of the same blend ratio. The characteristics of these cigarettes are shown in Tables 2 and 3, compared to a control. The two batches of cut rolled expanded stem (CRES) were shown to produce less dense (up to 4% actual weight saving, with potential for up to 7% weight saving) and therefore provided cheaper cigarettes with similar physical characteristics and an improved or equivalent taste.

EXAMPLE 12

Flue-cured lamina tobacco treated by the present process was blended with unexpanded (conventional) cut rolled stem (80:20). Cigarettes were made with this blend and compared with a control cigarette of the same physical characteristics. The characteristics of these cigarettes are shown in Tables 4 and 5. The puff number is reduced in cigarettes containing the expanded lamina. A significant decrease in density (up to 15%) was observed. There is therefore, a potential reduction in blend cost. Lamina treated with the present process was also found to alter the flavour of the cigarettes.

TABLE 1

| Sample Code | Tobacco Type | Description |
|---|---|---|
| 1 | CRS (Cut Rolled Stem) | CRS Control (Rotary Dryer) |
| 2 | CRES (Cut Rolled Expanded Stem) | CRES Low Pressure @ 33% m.c. ST (Trial 1) |
| 3 | | CRES Medium Pressure @ 33% m.c. ST (Trial 2) |
| 4 | | CRES High Pressure @ 33% m.c. ST (Trial 3) |
| 5 | | CRES High Pressure @ 45% m.c. ST (Trial 4) |
| 6 | | CRES Medium Pressure @ 45% m.c. LT (Trial 10) |
| 7 | | Dickinson A |
| 8 | | Dickinson B |
| 9 | | Hauni 8.5 bar 43% m.c. (Trial 1) |
| 10 | | Hauni 5 bar 38% m.c. (Trial 2a) |
| 11 | | Hauni 8.5 bar 38% m.c. (Trial 2b) |
| 12 | Flue-cured lamina portion (Blend 1) | Lamina Control (Rotary dryer) |
| 13 | | Lamina Low Pressure @ 33% m.c. ST (Trial 5) |
| 14 | | Lamina Medium Pressure @ 33% m.c. ST (Trial 7) |

TABLE 1-continued

| Sample Code | Tobacco Type | Description |
|---|---|---|
| 15 | | Lamina High Pressure @ 33% m.c. ST (Trial 6) |
| 16 | | Lamina Low Pressure @ 20% m.c. ST (Trial 8) |
| 17 | | Lamina High Pressure @ 33% m.c. LT (Trial 9) |
| 18 | | Lamina Dickinson LEDS - 50 |
| 19 | | Lamina Dickinson LEDS - 100 |
| 20 | | Lamina Hauni 26% m.c. (Trial 3) |
| 21 | | Lamina Hauni 33% m.c. (Trial 4) |
| 22 | Flue-cured Lamina portion (Blend 2) | Lamina Control |
| 23 | | Lamina Low Pressure @ 23% m.c. ST |
| 24 | | Lamina Medium Pressure @ 35% m.c. ST |
| 25 | | Lamikna High Pressure @ 35% m.c. LT |
| 26 | Burley Lamina | Burley Control (Cased Leaf Dryer) |
| 27 | | Burley Low Pressure @ 30% m.c. LT |
| 28 | | Burley Medium Pressure @ 30% m.c. LT |
| 29 | | Burley High Pressure @ 30% m.c. LT |
| 30 | | Burley High Pressure @ 30% m.c. ST |
| 31 | | Burley Hauni 28% m.c. (Trial 5) |
| 32 | Burley Lamina | Burley no casing |
| 33 | | Burley standard casing |
| 34 | | Burley casing a |
| 35 | | Burley casing b |

m.c. : moisture content
LT/ST : long/short residence time

TABLE 2

| | Control (99086) | CRES1 (99088) | CRES2 (99090) |
|---|---|---|---|
| tar/nic (mg/cig) | 6.8/0.61 | 6.0/0.51 | 6.6/0.63 |
| puff number | 8.0 | 8.1 | 8.5 |
| hardness (%) | 79 | 80 | 79 |
| end loss (mg/end) | 1.2 | 1.8 | 1.7 |
| density (g/l) | 230 | 216 | 219 |
| (target) | (224) | (214) | (219) |
| wt. saving (%) | — | 3.6 | 2.3 |
| (target) | | (4.5) | (2.3) |

TABLE 3

| | Control (99086) | CRES1 (99088) | CRES2 (99090) |
|---|---|---|---|
| HOV/KF (%) | 13.9/11.9 | 13.4/11.5 | 14.2/12.2 |
| Density (g/l) | | | |
| specification | 224 | 214 | 219 |
| found | 230 | 216 | 219 |
| Ds (equal softness) | 229 | 209 | 208 |
| Dp (equal pressure drop) | 223 | 207 | 216 |
| De (equal end loss) | 198 | 196 | 197 |

TABLE 4

| | Control (99082) | 10% reduction (99084) | 14% reduction (99085) |
|---|---|---|---|
| tar/nic (mg/cig) | 11.2/1.00 | 10.5/0.82 | 10.9/0.84 |
| puff number | 8.0 | 7.2 | 7.0 |
| hardness (%) | 79 | 78 | 79 |
| end loss (mg/end) | 2.1 | 4.4 | 2.4 |
| density (g/l) | 223 | 197 | 197 |
| (target) | (220) | (200) | (190) |
| wt. saving (%) | — | 10 | 10 |
| (target) | | (10) | (14) |

TABLE 5

| | Control (99082) | 10% reduction (99084) | 14% reduction (99085) |
|---|---|---|---|
| HOV/KF (%) | 13.3/11.5 | 13.2/11.4 | 12.8/10.9 |
| Density (g/l) | | | |
| specification | 220 | 200 | 190 |
| found | 223 | 197 | 197 |
| Ds | 224 | 203 | 204 |
| Dp | 228 | 206 | 210 |
| De | 206 | 199 | 186 |

TABLE 6

| Burley | CSV @ 14% HOV | % <0.81 mm | % >3.15 mm | Pressure KPa (Gauge) | Pressure Bar (absolute) | Feed Temp. (° C.) | Cyclone Temp. (° C.) | Kg/hr (ds) Through-put | Moist Meter (%) | Exit Moisture HOV | Expansion % over control |
|---|---|---|---|---|---|---|---|---|---|---|---|
| Control | 6.2 | 6.7 | 32 | | | | | | | 0% | |
| Low Pressure @ 35% m LT | 6.6 | 5.3 | 49 | 41 | 1.41 | 242 | 143 | 242 | 12 | 15% | 6.5 |
| Med. Pressure @ 35% m LT | 6.7 | 6.6 | 40 | 144 | 2.44 | 233 | 149 | 300 | 10.7 | 15% | 8.1 |
| High Pressure @ 35% m LT | 6.5 | 6.8 | 35 | 269 | 3.69 | 223 | 157 | 325 | 12.1 | 15% | 4.8 |
| High Pressure @ 35% m ST | 6.4 | 7.6 | 34 | 260 | 3.60 | 224 | 179 | 246 | 10.5 | 17% | 3.2 |

TABLE 7A

| Flue-Cured Lamina (Blend 1) | CSV @ 14% HOV | % <0.81 mm | % >3.15 mm | Pressure KPa (Gauge) | Pressure Bar (absolute) | Feed Temp. (° C.) | Cyclone Temp. (° C.) | Kg/hr (ds) Throughput | Moist Meter (%) | Exit Moisture HOV | Expansion % over control |
|---|---|---|---|---|---|---|---|---|---|---|---|
| Control | 5.3 | 5.3 | 34 | | | | | | | 14% | |
| Low Pressure @ 33% m ST | 5.8 | 5.4 | 48 | 14 | 1.14 | 245 | 163 | 118.2 | 12.3 | 15% | 9% |
| High Pressure @ 33% m ST | 5.9 | 4.1 | 45 | 271 | 3.71 | 254 | 177 | 480 | 10.5 | 16% | 9% |
| Medium Pressure @ 33% m ST | 6.2 | 6.5 | 26 | 157 | 2.57 | 230 | 161 | 270 | 12.6 | 15% | 17% |
| Low Pressure @ 20% m ST | 6.0 | 4.9 | 36 | 11 | 1.11 | 195 | 138 | 168 | 11.2 | 15% | 13% |
| High Pressure @ 33% m LT | 5.4 | 5.6 | 32 | 183 | 2.83 | 218 | 154 | na | 11.7 | 16% | 2% |
| Flue-Cured (Blend 2) | | | | | | | | | | | |
| Control | 5.2 | | | | | | | | | | |
| Medium Pressure @ 35% m ST | 5.4 | 6.6 | 35 | 131 | 2.31 | 227 | 172 | 210 | 11.5 | 19% | 2% |
| High Pressure @ 35% m ST | 5.5 | 9.5 | 28 | 256 | 3.56 | 219 | 150 | 192 | 11.9 | 16% | 6% |
| Low Pressure @ 23% m ST | 5.9 | 5.1 | 45 | 20 | 1.20 | 216 | 145 | 198 | 10.5 | 15% | 13% |

TABLE 7B

| CRS | CSV @ 14% HOV | % <0.81 mm | % >3.15 mm | Pressure KPa (Gauge) | Pressure Bar (absolute) | Feed Temp. (° C.) | Cyclone Temp. (° C.) | Kg/hr (ds) Throughput | Moist Meter (%) | Exit Moisture HOV | Expansion % over control |
|---|---|---|---|---|---|---|---|---|---|---|---|
| Control | 6.2 | 3.04 | 43 | | | | | | | 14% | |
| Low Pressure @ 33% m ST | 6.9 | 2.2 | 51 | 30 | 1.3 | 267 | 190 | 72.4 | 12.1 | 17% | 11% |
| Medium Pressure @ 33% m ST | 7.2 | 2.1 | 55 | 109 | 2.09 | 252 | 191 | 98.4 | 12.2 | 15% | 16% |
| High Pressure @ 33% m ST | 7.1 | 2.6 | 51 | 192 | 2.92 | 272 | 192 | 180 | 10.4 | 12% | 15% |
| High Pressure @ 45% m ST | 7.6 | 2.7 | 54 | 300 | 4 | 264 | 210 | 162 | 11.4 | 17% | 23% |
| Medium Pressure @ 45% m LT | 7.4 | 2 | 60 | 161 | 2.61 | 249 | 177 | 72 | 12 | 19% | 19% |

TABLE 8

Probability values associated with F values of the two-factor ANOVA (tobacco type and judge) for thirteen aroma attributes and across the three tobacco types (CRS = 1, lamina = 2 and Burley = 3).

| Attribute | Tobacco Type | Judges | Duncan Test |
|---|---|---|---|
| Intensity | * | *** | 321 |
| Acidic/Rancid | *** | *** | 321 |
| Ammoniac | *** | *** | 321 |
| Animal | *** | *** | 321 |
| Burnt caramellic | ns | *** | |
| Caramellic | ** | *** | 213 |
| Chocolate/Cocoa | ns | *** | |
| Fermented/Fruity | ns | *** | |
| Grassy/Green | ns | *** | |
| Hay-like | ns | *** | |

TABLE 8-continued

Probability values associated with F values of the two-factor ANOVA (tobacco type and judge) for thirteen aroma attributes and across the three tobacco types (CRS = 1, lamina = 2 and Burley = 3).

| Attribute | Tobacco Type | Judges | Duncan Test |
|---|---|---|---|
| Musty/Earthy | ** | *** | 321 |
| Nutty/Roasted | ** | *** | 123 |
| Woody | * | *** | 123 |

*P < 0.05
**P < 0.01
*** P < 0.001

Tobacco types within an attribute underlined differently differ according to the. Duncan Test (P<0.05)

TABLE 9

Probability values associated with F values of the two-factor ANOVA (CRS tobacco samples and judge) for thirteen aroma attributes and across the 35 associations.

| Attribute | Tobacco Type | Judges | Duncan Test |
|---|---|---|---|
| Intensity | * | *** | 11 6 5 2 8 4 9 10 3 1 7 |
| Acidic/Rancid | ns | *** | |
| Ammoniac | ns | *** | |
| Animal | ns | *** | |
| Burnt caramellic | ns | *** | |
| Caramellic | ns | *** | |
| Chocolate/Cocoa | ns | *** | |
| Fermented/Fruity | ns | *** | |
| Grassy/Green | * | *** | 4 2 1 5 11 9 7 8 3 10 6 |
| Hay-like | ns | *** | |
| Musty/Earthy | ns | *** | |
| Nutty/Roasted | ns | *** | |
| Woody | ns | *** | |

*P < 0.05
**P < 0.01
***P < 0.001

Tobacco types within an attribute underlined differently differ according to the Duncan test (P<0.05).

TABLE 10

Probability values associated with F values of the two-factor ANOVA (lamina tobacco samples and judge) for thirteen aroma attributes and across the 35 associations.

| Attribute | Tobacco Type | Judges |
|---|---|---|
| Intensity | ns | *** |
| Acidic/Rancid | ns | *** |
| Ammoniac | ns | *** |
| Animal | ns | *** |
| Burnt caramellic | ns | *** |
| Caramellic | ns | *** |
| Chocolate/Cocoa | ns | *** |
| Fermented/Fruity | ns | *** |
| Grassy/Green | ns | *** |
| Hay-like | ns | *** |
| Musty/Earthy | ns | *** |
| Nutty/Roasted | ns | *** |
| Woody | ns | *** |

*P < 0.05
**P < 0.01
***P < 0.001

Tobacco types within an attribute underlined differently differ according to the Duncan test (P<0.05).

TABLE 11

Probability values associated with F values of the two-factor ANOVA (Burley tobacco samples and judge) for thirteen aroma attributes and across the 35 associations.

| Attribute | Tobacco Type | Judges | Duncan Test |
|---|---|---|---|
| Intensity | * | *** | 27 29 30 31 35 26 28 33 32 34 |
| Acidic/Rancid | ns | *** | |
| Ammoniac | ns | *** | |
| Animal | * | *** | 35 33 32 31 28 34 26 30 27 29 |
| Burnt caramellic | ns | *** | |
| Caramellic | * | *** | 28 30 29 27 31 34 32 33 35 26 |
| Chocolate/Cocoa | ns | *** | |
| Fermented/Fruity | ns | *** | |
| Grassy/Green | ns | *** | |
| Hay-like | ns | *** | |
| Musty/Earthy | ns | *** | |
| Nutty/Roasted | ns | *** | |
| Woody | ns | *** | |

*P < 0.05

**P < 0.01

***P < 0.001

Tobacco types within an attribute underlined differently differ according to the Duncan test (P < 0.05).

TABLE 12

Attribute Key

Due to the lack of space around the circumference of the flavour wheel many of the sensory attribute names have been abbreviated to improve visibility.
Below is a table of descriptions for the abbreviations.

| Abbreviation | Description | Abbreviation | Description |
|---|---|---|---|
| smamp | Amplitude - Aroma | sweet | Sweet Taste |
| dpamp | Amplitude - Dry Puff | bitter | Bitter Taste |
| atamp | Amplitude - Aftertaste | metal | Metallic Taste |
| amp | Amplitude | sour | Sour Taste |
| hay | Hay | salty | Salty Taste |
| green | Green | noseI | Nose Irritation |
| herb | Herbal | mouthI | Mouth Irritation |
| flor | Floral | thrI | Throat Irritation |
| fruit | Fruity | tongI | Tongue Irritation |
| nutty | Nutty | genI | General Overall Irritation |
| spicy | Spicy | dry | Dryness |
| woody | Woody | hot | Temperature/Hotness |
| earth | Earthy/Forest | dusty | Dusty/Dry |
| rancid | Rancid | cloy | Cloying |
| animal | Animal/Sweaty | impact | Impact |
| faecal | Faecal | lift | Lift |
| caramel | Caramellic | light | Lightness |
| roast | Roasted/Toasted | full | Fullness |
| choc | Chocolate/Cocoa | fbal | Flavour Balance |
| smoky | Smoky | harmony | Harmony |
| tarry | Tarry | fresh | Fresh |
| ammon | Ammoniacal | off | Off-Flavour |
| med | Medicated | draw | Ease of Draw |
| menthol | Menthol | ease | Ease of Getting Smoke |
| flue | Flue | thick | Thickness/Smoke Density |
| added | Added Flavour | | |
| burley | Burley | | |
| blend | Blended | | |
| ori | Oriental | | |

TABLE 13

Mean Scores and F ratios

| | Control S99113 | HP/LT S99114 | HP/ST S99115 | F ratio |
|---|---|---|---|---|
| Amplitude | 89.35 | 83.85 | 83.71 | 9.56* |
| Floral | 5.17 | 6.40 | 7.25 | 3.78* |
| Spicy | 48.71 | 40.67 | 42.48 | 11.19* |
| Chocolate/Cocoa | 3.21 | 7.90 | 11.77 | 5.88* |
| Smoky | 70.38 | 68.21 | 62.33 | 5.50* |
| Tarry | 68.13 | 62.65 | 59.65 | 10.35* |
| Ammoniacal | 31.33 | 24.40 | 24.04 | 4.59* |
| Burley | 76.92 | 68.92 | 67.73 | 6.48* |
| Bitter Taste | 66.42 | 60.06 | 54.17 | 7.17* |
| Throat Irritation | 89.69 | 76.65 | 78.29 | 19.41* |
| General Overall Irritation | 89.33 | 78.63 | 77.10 | 14.38* |
| Impact | 91.81 | 80.58 | 79.92 | 19.47* |
| Flavour Balance | 66.88 | 80.06 | 74.60 | 8.23* |
| Harmony | 63.17 | 73.65 | 74.21 | 12.19* |

F (0.05; 2,22) = 3.44
F (0.01; 2,22) = 5.72
*denotes significance at p = 0.05

What is claimed is:

1. A process of treating Burley tobacco only in a Burley processing line, said process comprising:

heating Burley tobacco at ambient pressure to an input temperature of about 50° C. to 100° C.;

introducing said Burley tobacco at said input temperature of about 50° C. to 100° C. with an input moisture content of 20% to 45% into a superheated steam flow of 200° C. to 300° C. in a pressurised pneumatically conveyed closed loop dryer;

heating said Burley tobacco in said pressurised pneumatically conveyed closed loop dryer to a tobacco temperature of 120° C. or more at a pressure which is in a range of 0.25 to 7 Bar absolute;

separating said Burley tobacco from said superheated steam flow;

discharging said Burley tobacco from said pressurised pneumatically conveyed closed loop dryer, the moisture content of Burley tobacco being maintained above 10% during the process, and the moisture content of the Burley tobacco exiting said pneumatically conveyed closed loop dryer being greater than 10%; and cooling said Burley tobacco, the aroma and taste and flavour characteristics of thus treated Burley tobacco being altered to become more toasted.

2. A process according to claim 1, wherein the superheated steam is a conveying and drying medium.

3. A process according to claim 1, wherein said Burley tobacco used in the process is pre-cut.

4. A process according to claim 1, wherein said Burley tobacco is cut after processing.

5. A process according to claim 1, wherein said Burley tobacco used in said process has an input moisture content above 20%.

6. A process according to claim 5, wherein said Burley tobacco has an input moisture content of 25% or more.

7. A process according to claim 6, wherein said Burley tobacco has an input moisture content of 30% or more.

8. A process according to claim 7, wherein said Burley tobacco has an input moisture content of up to 45%.

9. A process according to claim 1, wherein said superheated steam is at a temperature of 220° C. or more.

10. A process according to claim 1 , wherein said superheated steam is at a temperature of 230° C., or more.

11. A process according to claim 1, wherein said Burley tobacco is heated in said loop dryer to a temperature of at least 130° C.

12. A process according to claim 1, wherein said Burley tobacco is heated in said loop dryer to a temperature of at least 140° C.

13. A process according to claim 1, wherein said dryer is operated at pressures of from 1 to 6 Bar absolute.

14. A process according to claim 13, wherein said dryer is operated at pressures of above 2 Bar absolute.

15. A process according to claim 14, wherein said dryer is operated at pressures in the range of 3 to 6 Bar absolute.

16. A process according to claim 1, wherein the residence time of said Burley tobacco at elevated temperature and pressure is from 5 to 25 seconds.

17. A process according to claim 16, herein the residence time of said Burley tobacco at elevated temperature and pressure is in the range of 7 to 15 seconds.

18. A process according to claim 16, wherein said residence time is 7–8 seconds.

19. A process according to claim 17, wherein said residence time is 15 seconds.

20. A process according to claim 1, wherein the exit moisture content of said Burley tobacco is from 10% to 25%.

21. A process according to claim 20, wherein the exit moisture content of said tobacco is 14% to 16%.

22. A process according to claim 1, wherein said Burley tobacco is expanded by 7% or more.

23. A process according to claim 22, wherein said Burley tobacco is expanded by 10% or more.

24. A process according to claim 23, wherein said Burley tobacco is expanded by 15% or more.

25. A process according to claim 1, wherein one or more casing materials is added to said Burley tobacco.

26. A smoking article comprising a filter element attached to a smoking material rod wrapped in a wrapper, the rod comprising Burley tobacco processed according to claim 1.

27. A process of treating Burley tobacco only in a Burley processing line, said process comprising heating Burley tobacco at ambient pressure to a temperature in a range of 60° C. to 70° C. before said process, and heating said Burley tobacco in said Burley processing line in a pressurised pneumatically conveyed closed loop drier to a tobacco temperature of 120° C. or more at a pressure which is in a range of 0.25 to 7 Bar absolute, a moisture content of said Burley tobacco being maintained above 10% during said process, and said moisture content of said Burley tobacco exiting said pressurised pneumatically conveyed closed loon dryer being greater than 10%, the aroma and taste and flavour characteristics of thus treated Burley tobacco being altered to become more toasted.

28. A process for treating only tobacco stem or only flue-cured lamina tobacco in a pressurised pneumatically conveyed closed loop dryer, said process comprising:

introducing tobacco stem or flue-cured lamina tobacco having an input temperature of about 50° C. into a superheated steam flow of 150° C. to 300° C. in a pressurised pneumatically conveyed closed loop dryer;

heating said tobacco stem or flue-cured lamina tobacco to a tobacco temperature up to 120° C. at a pressure which is in the range of 1–4 Bar absolute;

separating said tobacco stem or flue-cured lamina tobacco from said superheated steam flow;

discharging said tobacco stem or flue-cured lamina tobacco from said pressurised pneumatically conveyed closed loop dryer, the moisture content of said tobacco stem or flue-cured lamina tobacco being maintained above 10% during the process, and the moisture content of said tobacco stem or flue-cured lamina tobacco exiting said pneumatically conveyed closed loop dryer being greater than 10%; and cooling said tobacco stem or flue-cured lamina tobacco, in order to provide a filling power improvement compared with conventional stem or flue-cured lamina processes.

* * * * *